US010522305B2

(12) United States Patent
Carbone et al.

(10) Patent No.: US 10,522,305 B2
(45) Date of Patent: Dec. 31, 2019

(54) POWER SWITCH ENCLOSURE

(71) Applicant: Hubbell Incorporated, Shelton, CT (US)

(72) Inventors: Christopher A. Carbone, Newtown, CT (US); Thomas L. Scanzillo, Monroe, CT (US); Greg McAleer, Fairfield, CT (US); Roy Itzler, Orange, CT (US); Robert Simon, Shelton, CT (US); Steve Liscinsky, Stratford, CT (US)

(73) Assignee: Hubbell Incorporated, Shelton, CT (US)

( * ) Notice: Subject to any disclaimer, the term of this patent is extended or adjusted under 35 U.S.C. 154(b) by 83 days.

(21) Appl. No.: 15/642,489

(22) Filed: Jul. 6, 2017

(65) Prior Publication Data

US 2018/0012709 A1 Jan. 11, 2018

Related U.S. Application Data

(60) Provisional application No. 62/358,931, filed on Jul. 6, 2016, provisional application No. 62/450,142, filed on Jan. 25, 2017.

(51) Int. Cl.

| | |
|---|---|
| ***H01H 9/16*** | (2006.01) |
| ***H01H 9/02*** | (2006.01) |
| ***H01H 71/04*** | (2006.01) |
| ***H01H 71/50*** | (2006.01) |

(52) U.S. Cl.

CPC ..... *H01H 9/161* (2013.01); *H01H 9/0271* (2013.01); *H01H 71/04* (2013.01); *H01H 71/501* (2013.01); *H01H 2071/042* (2013.01)

(58) Field of Classification Search

CPC ..... H01H 9/161; H01H 9/0271; H01H 71/04; H01H 71/501; H01H 2071/042

See application file for complete search history.

(56) References Cited

U.S. PATENT DOCUMENTS

| | | | | |
|---|---|---|---|---|
| 4,645,886 A * | 2/1987 | Williams | H01H 3/001 | 200/1 R |
| 4,647,727 A * | 3/1987 | Sontheimer | H01H 3/001 | 200/1 R |
| 5,219,070 A * | 6/1993 | Grunert | H01H 9/281 | 200/330 |
| 5,302,925 A * | 4/1994 | Castonguay | H01H 71/501 | 200/43.14 |
| 6,614,635 B2 * | 9/2003 | Behrens | H01H 47/005 | 307/125 |

* cited by examiner

*Primary Examiner* — Felix O Figueroa
(74) *Attorney, Agent, or Firm* — Michael Best & Friedrich, LLP

(57) ABSTRACT

A power switch including a contact configured to selectively electrically connect a line input to a load output, a switch configured to selectively control the contract, and an indicator. The contact has a closed position in which the line input is electrically connected to the load output, and an open position in which the line input is not electrically connected to the load output. The switch has an on position wherein the contact is controlled to be in the closed position, and an off position wherein the contact is controlled to be in the open position. The indicator provides a normal on status, a normal off status, and an error on status.

19 Claims, 20 Drawing Sheets

POWER SWITCH ENCLOSURE

RELATED APPLICATIONS

The present applications relates to U.S. Provisional Patent Application No. 62/358,931, filed on Jul. 6, 2016, and U.S. Provisional Patent Application No. 62/450,142, filed on Jan. 25, 2017. The entire contents, both of which, are hereby incorporated by reference.

FIELD

Embodiments relate to a power switch and an enclosure for the same.

SUMMARY

Power switches selectively electrically connect a line power to a load. Typically, power switches include a user-switch having an ON position and an OFF position. When the user-switch in is the ON position line power is provided to the load. When the user-switch is in the OFF position line power is not provided to the load. However, such power switches fail to notify the user when there is an error, such as but not limited to, when line power is being provided to the load but the user-switch is in the OFF position. Such a situation may occur when one or more contacts of the power switch are welded together.

Accordingly, in one embodiment, the application provides a power switch including a line input configured to receive a line voltage, a load output configured to output the line voltage, a contact configured to selectively electrically connect the line input to the load output, a switch configured to selectively control the contract between the open position and the closed position, and an indicator. The contact has a closed position in which the line input is electrically connected to the load output, and an open position in which the line input is not electrically connected to the load output. The switch has an on position wherein the contact is controlled to be in the closed position, and an off position wherein the contact is controlled to be in the open position. The indicator provides a normal on status wherein the indicator is activate when the switch is in the on position and the contact is in the closed position, a normal off status wherein the indicator is inactive when the switch is in the off position and the contact is in the open position, and an error on status wherein the indicator is active when the switch is in the off position and the contact is in the closed position.

In another embodiment the application provides a power switch including a housing, and indicator, and an indicator lens. The housing includes a rear portion and a front cover coupled to the rear portion. The indicator is supported by the front cover, the indicator is configured to provide an indication of the power switch. The indicator lens is positioned between the indicator and the front cover.

In another embodiment, the application provides a power switch including a housing and a mounting foot. The mounting foot is configured to secure the housing to a surface. The mounting foot includes a molding and an insert contained within the molding.

In another embodiment, the application provides a power switch housing including a front cover and a rear housing. The front cover includes a retainer configured to captivate a fastener. In some embodiments the fastener includes a groove and a threaded portion. The rear housing is configured to be coupled to the front cover via the fastener.

Other aspects of the application will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
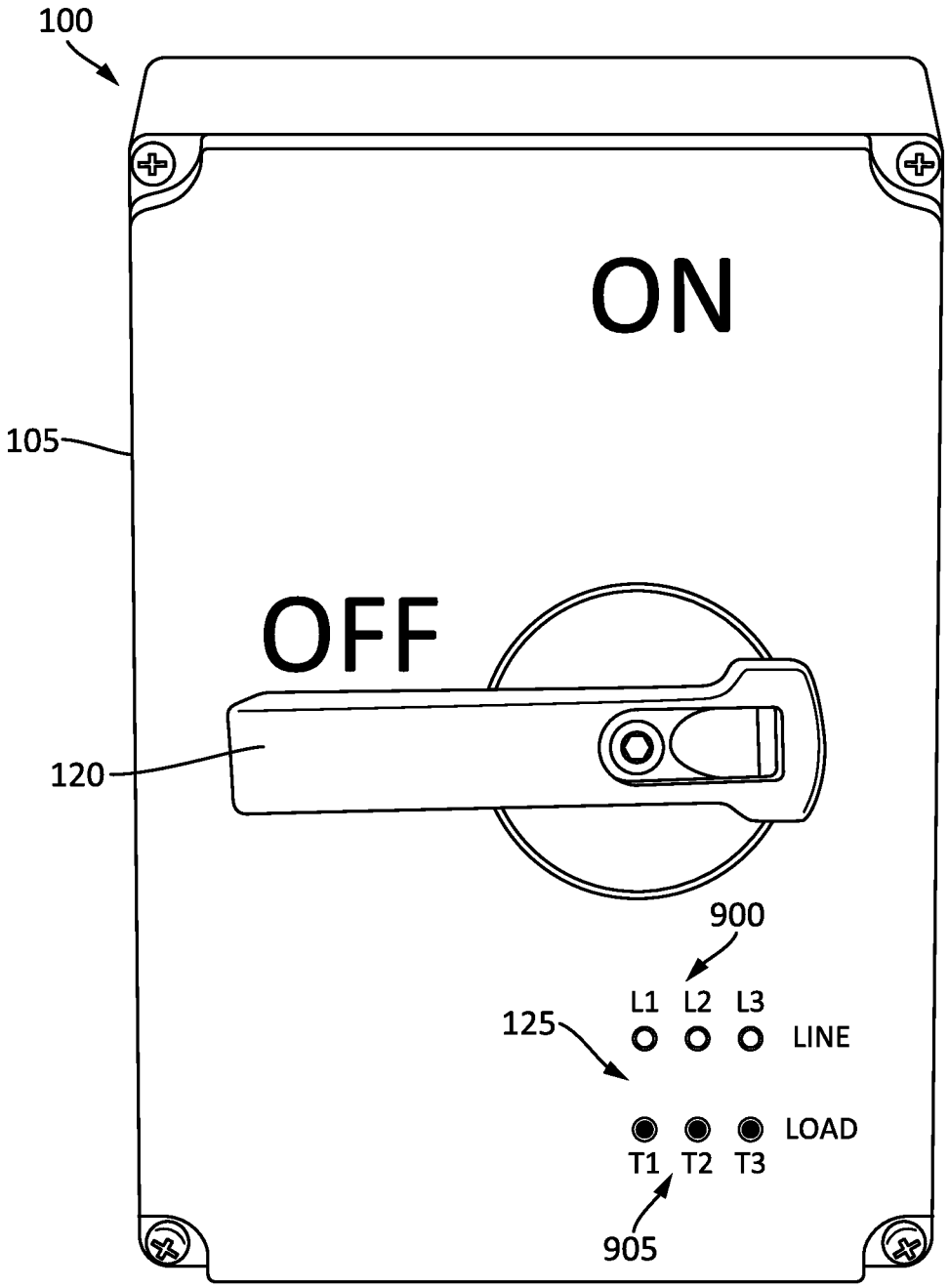
FIG. 1A illustrates a front view of a power switch enclosure according to some embodiments of the application.
Figure 1B:
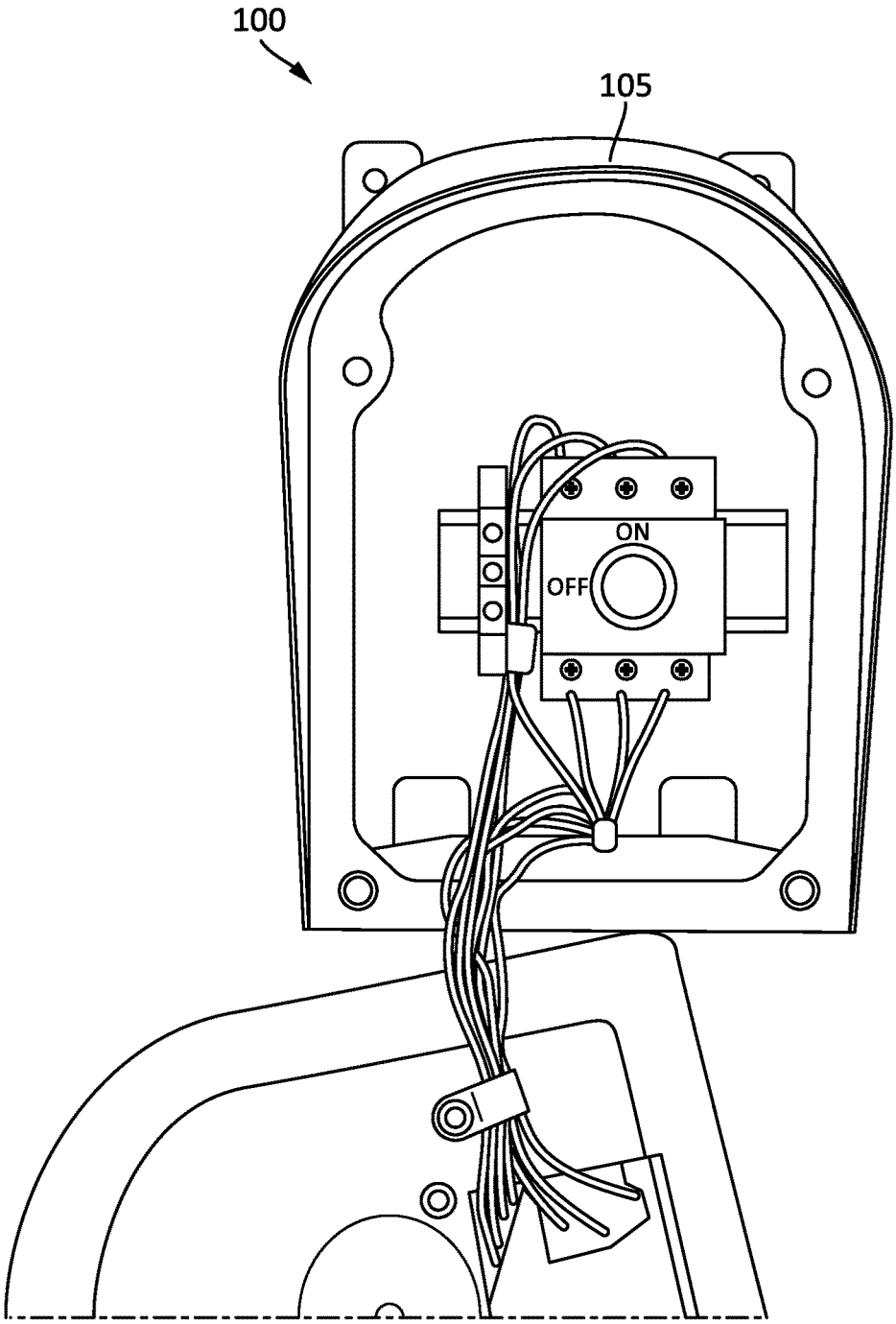
FIG. 1B illustrates a front view of a power switch enclosure with a front cover removed according to some embodiments of the application.

FIG. 1A illustrates a front view of a power switch enclosure 100 according to some embodiments of the application. The power switch enclosure 100 is configured to selectively control and electrical connection between line power to a load. In some embodiments, the load is a motor, such as but not limited to, an alternating-current (AC) motor or a direct-current (DC) motor. In some embodiments, the power switch enclosure 100 is configured to provide a line power having a voltage within a range of approximately 120V AC to approximately 600V AC and a maximum current of approximately 600 mA. The power switch enclosure 100 includes an enclosure, or housing, 105, a user-switch 120, and an indicator 125. In some embodiments, the housing 105 may be formed of an insulating material, such as but not limited to, a plastic material. In other embodiments, the housing 105 may be formed of a metallic material, such as but not limited to, stainless steel. Although illustrated as having a rectangular shape, in other embodiments, such as illustrated in FIG. 1B, the housing 105 may have a circular, semi-circular, or sloped shape.

Figure 2:
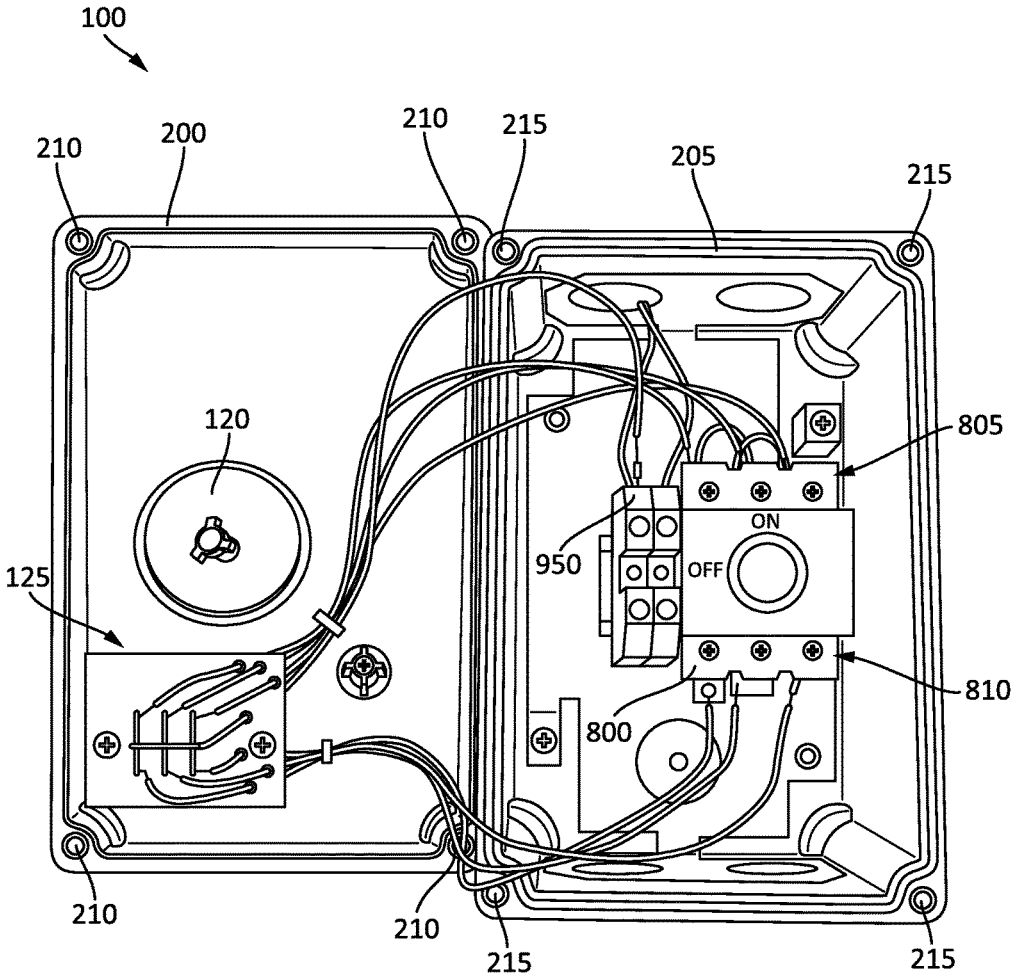
FIG. 2 illustrates a front view of the power switch enclosure of FIG. 1 with a front cover removed according to some embodiments of the application.

FIG. 2 illustrates the power switch enclosure 100 with a front cover 200 of the housing 105 removed from a rear portion 205 of the housing 105. The front cover 200 is connected to the rear portion 205 via one or more fasteners 300 (FIG. 3) at one or more front fastener locations 210 and one or more rear fastener locations 215. In some embodiments, the front cover 200 is selectively removable from the rear portion 205. In such an embodiment, the front cover 200 is replaceable. In some embodiments, the front cover 200 may be a replacement cover on a pre-existing power switch enclosure.

Figure 3:
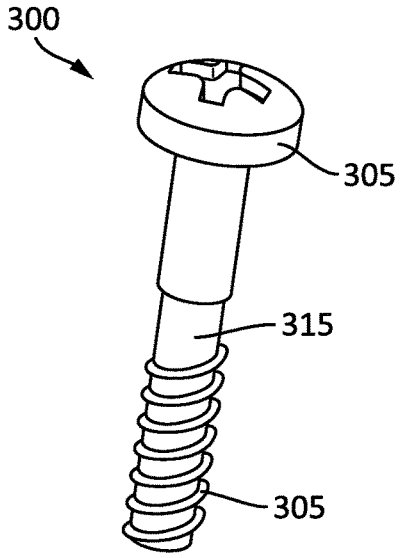
FIG. 3 illustrates a fastener of the power switch enclosure of FIG. 1 according to some embodiments of the application.
Figure 4:
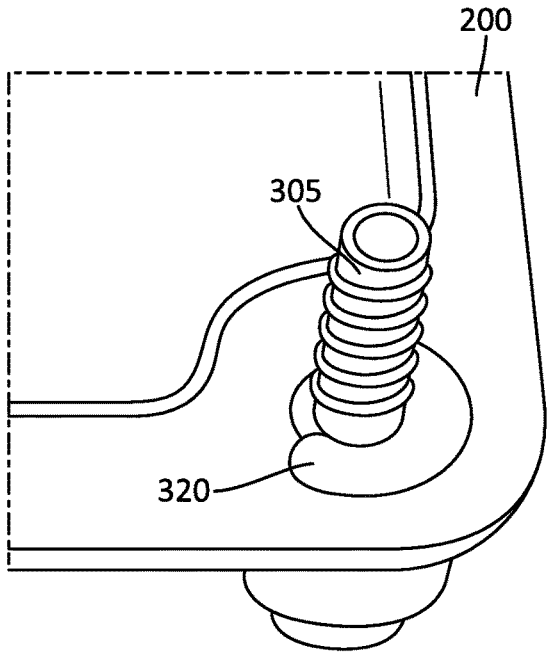
FIG. 4 illustrates the fastener of FIG. 3 captivated at a front fastener location of the front cover of the power switch enclosure of FIG. 1 according to some embodiments of the application.

FIG. 3 illustrates a fastener 300 according to one embodiment of the application. The fastener 300 includes a fastener head 305, a threaded portion 310, and a groove 315. FIG. 4 illustrates the fastener 300 captivated at the front fastener location 210 of the front cover 200 according to an embodiment of the application. In such an embodiment, the fastener 300 is captivated by a retainer 320. In the illustrated embodiment, the retainer 320 is a retaining ring. In such an embodiment, the retainer 320 may be formed of metal. The retainer 320 may be coupled to the front cover 200 via a counter bore. The retainer 320 captivates the fastener 300 at the groove 315.

Figure 5:
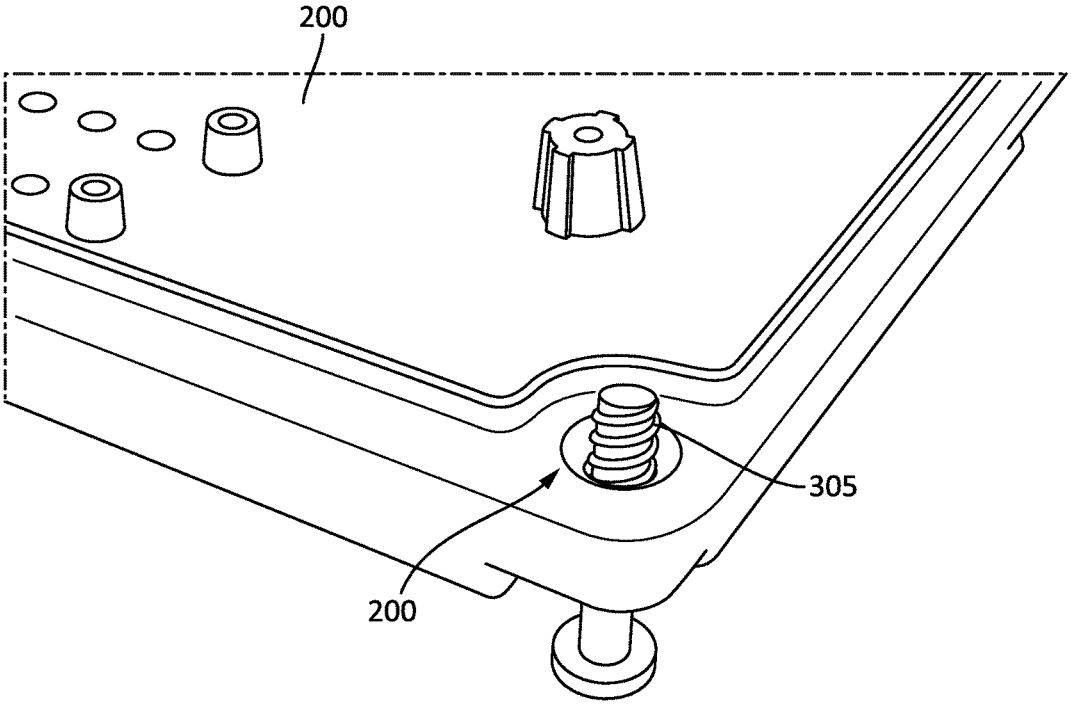
FIG. 5 illustrates the fastener of FIG. 3 captivated at a front fastener location of the front cover of the power switch enclosure of FIG. 1 according to another embodiment of the application.
Figure 6A:
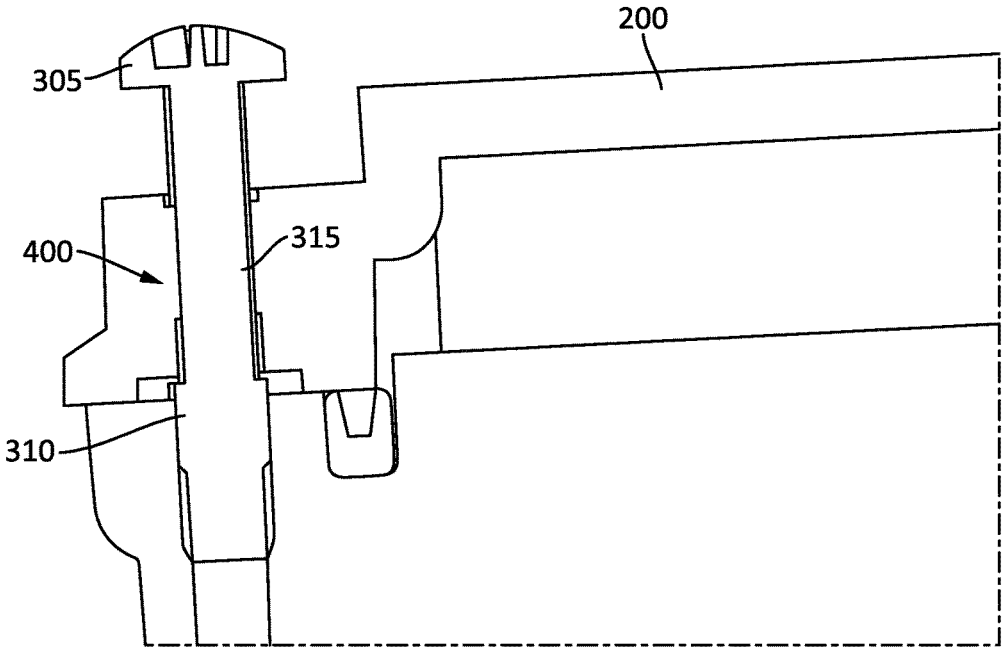
FIGS. 6A & 6B illustrate a cutaway view of the fastener of FIG. 3 captivated at a front fastener location of the front cover of the power switch enclosure of FIG. 1 according to some embodiments of the application.
Figure 6B:
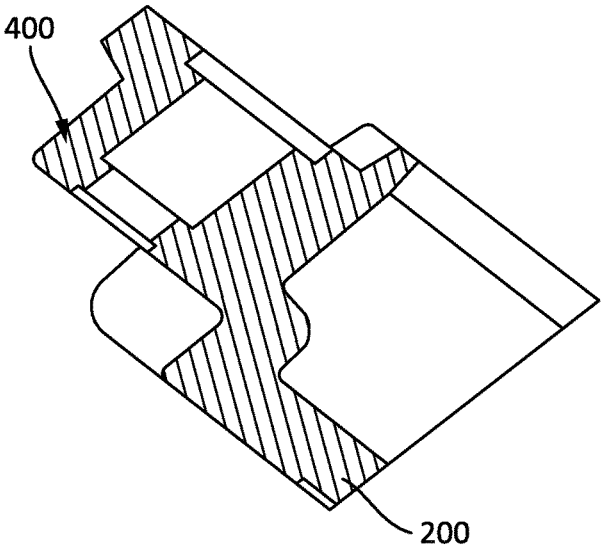

FIGS. 5, 6A & 6B illustrate the fastener 300 captivated at the front fastener location 210 of the front cover 200 according to other embodiments of the application. In such an embodiment, the front cover 200 includes a retainer 400 integrated into the front cover 200. The retainer 400 captivates the fastener 300 at the groove 315.

Figure 7A:
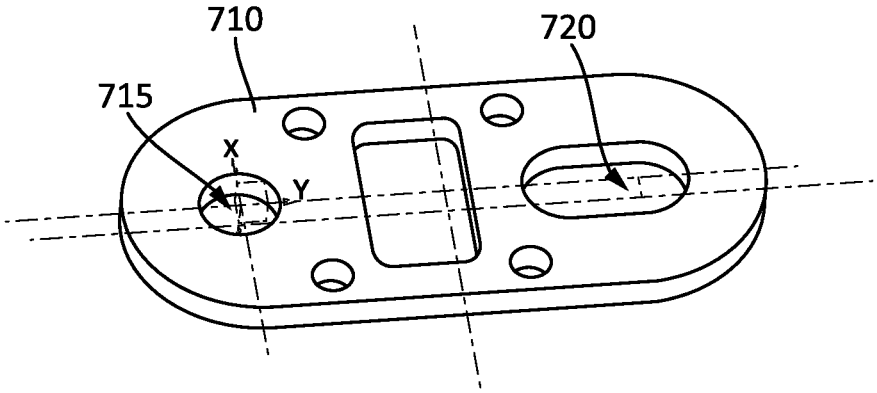
FIG. 7A illustrates a perspective view of an insert of a mounting foot of the power switch enclosure of FIG. 1 according to some embodiments of the application.
Figure 7B:
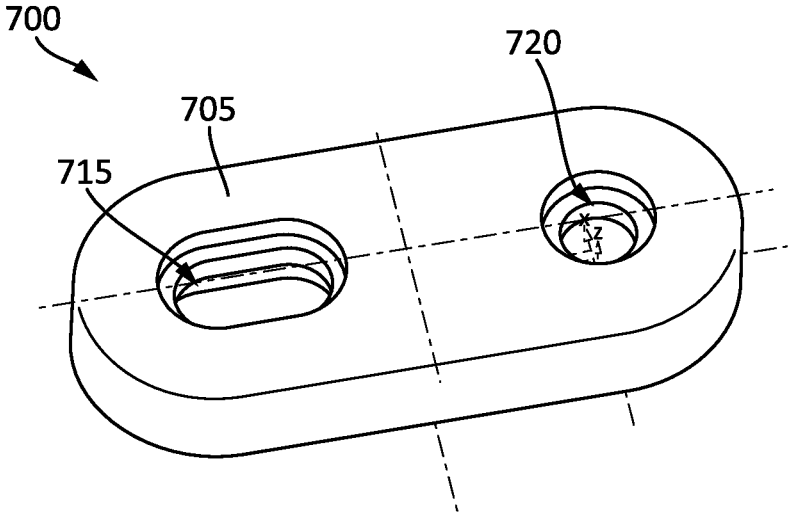
FIG. 7B illustrates a perspective view of a mounting foot of the power switch enclosure of FIG. 1 according to some embodiments of the application.

FIGS. 7A and 7B illustrate a mounting foot 700 of the power switch enclosure 100 according to some embodiments of the application. The mounting foot 700 may include a molding 705, an insert 710, a first mounting aperture 715, and a second mounting aperture 720. The molding 705 may be formed of an insulating material, such as but not limited to, a plastic material. The molding 705 is configured to be molded over the insert 710. The insert 710 may be formed of a rigid material, such as but not limited to a metal (e.g., steel, stainless steel, etc.). In such an embodiment, the insert 710 provides strength and rigidity to the mounting foot 700, while the molding 705 provides insulation between the power switch enclosure 100 and a surface 750. In other embodiments, the mounting foot 700 may be formed of a glass-filled plastic, such as but not limited to, a Valox material (for example, Valox 430 PBT).

Figure 8:
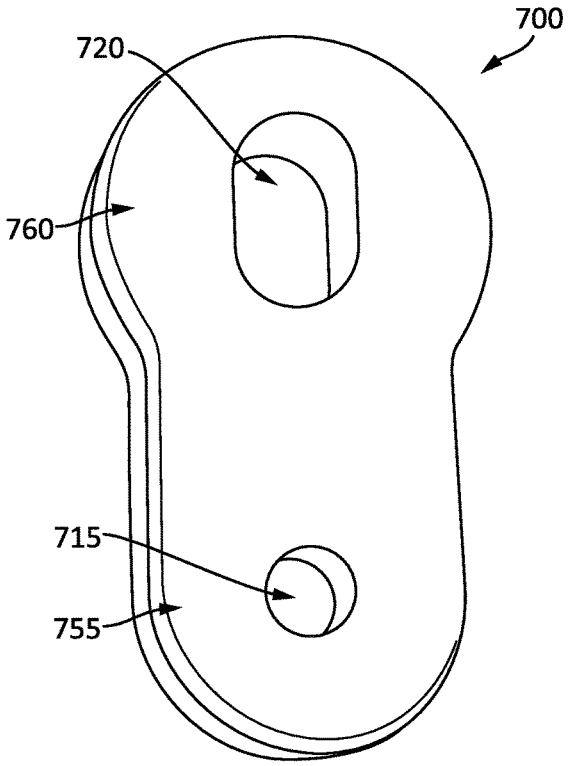
FIG. 8 illustrates a front view of a mount foot according to another embodiment of the application.

FIG. 8 illustrates a mounting foot 700 according to another embodiment of the application. In such an embodiment, the mounting foot 700 further includes a lower portion 755 surrounding the first mounting aperture 715 and an upper portion 760 surrounding the second mounting aperture 720. The lower portion 755 may have a width of approximately 0.75 in, while the upper portion 760 may have a circumference of approximately 1.0 in.

Figure 9:
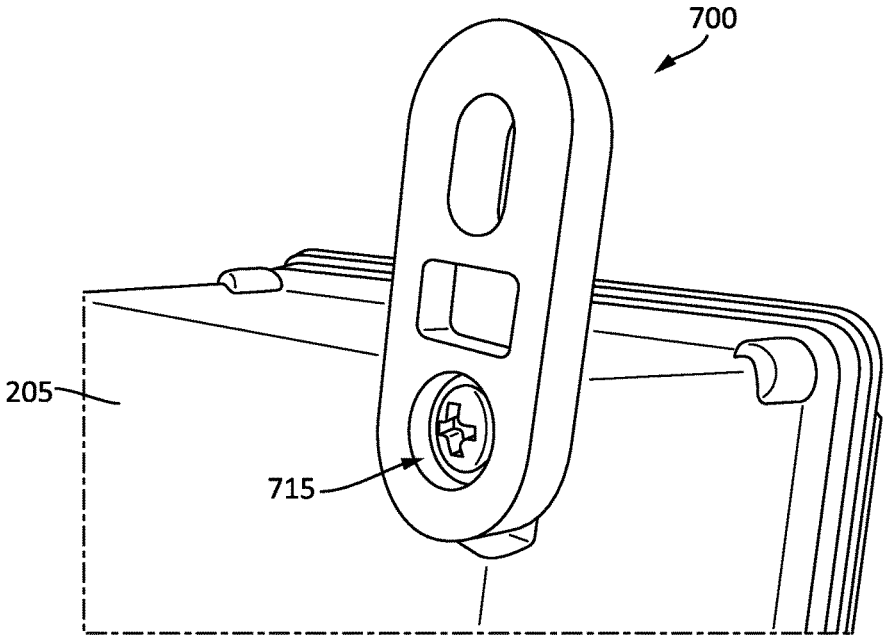
FIG. 9 illustrates a perspective view of the mounting foot of FIG. 8 coupled to a housing of the power switch enclosure of FIG. 1 according to some embodiments of the application.
Figure 10:
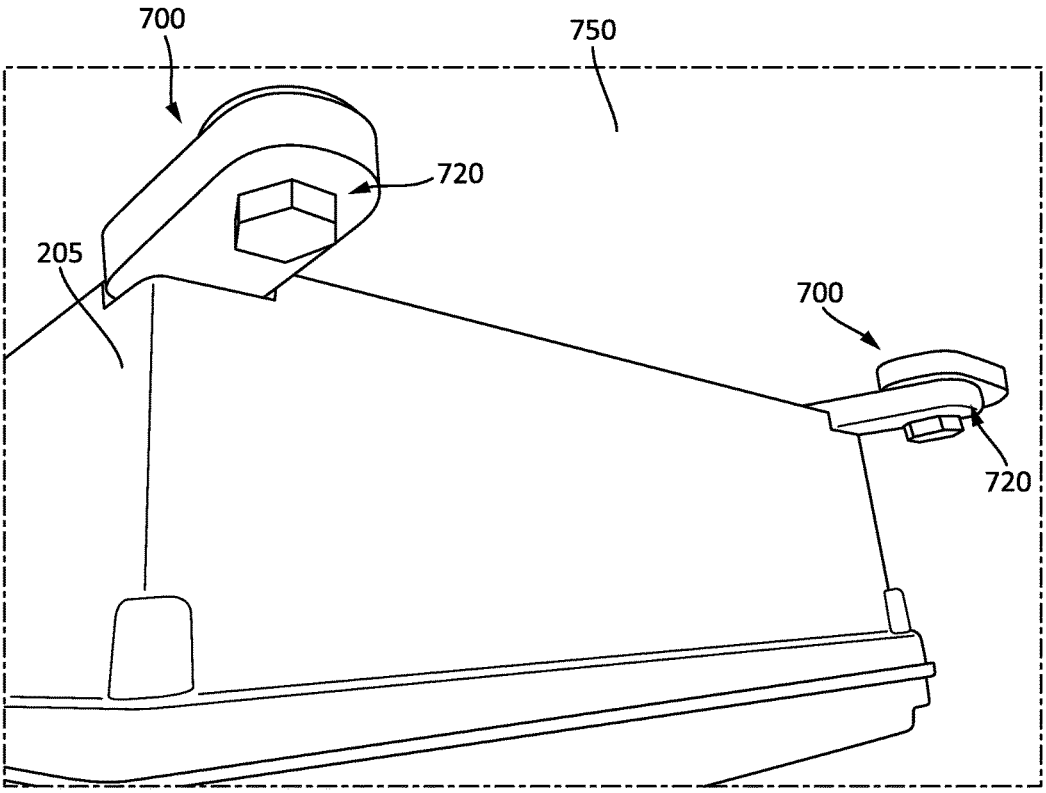
FIG. 10 illustrates a perspective view of the power switch enclosure of FIG. 1 coupled to a surface via the mounting foot of FIG. 8 according to some embodiments of the application.

FIG. 9 illustrates the mounting foot 700 coupled to the housing 105 of the power switch enclosure 100. In the illustrated embodiment, the mounting foot 700 is coupled to the rear portion 205 of the housing via a fastener at the first mounting aperture 715. FIG. 10 illustrates the power switch enclosure 100 coupled to the surface 750 via one or more mounting feet 700, according to some embodiments of the application. In the illustrated embodiment, the mounting feet 700 are coupled to the surface 750 via fasteners at the second mounting apertures 720. In other embodiments, the mounting foot 700 is coupled to the housing 105 via a welding process.

As illustrated in FIGS. 1 and 2, the housing 105 supports the user-switch 120, the indicator 125, and an electrical switch 800. The electrical switch 800 includes a line input 805 and a load output 810. The line input 805 is configured to electrically connect to the line while the load output 810 is configured to electrically connect to the load. The electrical switch 800 is coupled to the user-switch 120 and configured to be operated by the user-switch 120. The user-switch 120 includes an ON position and an OFF position. When the user-switch 120 is in the ON position, the electrical switch 800 is also in the ON position and electrically connects the line input 805 to the load output 810, thus providing line power to the load. When the user-switch 120 is in the OFF position, the electrical switch 800 is also in the OFF position and electrically disconnects the line input 805 from the load output 810, thus line power is not provided to the load. In some embodiments, the electrical switch 800 includes one or more contacts 815 (FIG. 12) for selectively electrically connecting the line input 805 to the load output 810.

Figure 11:
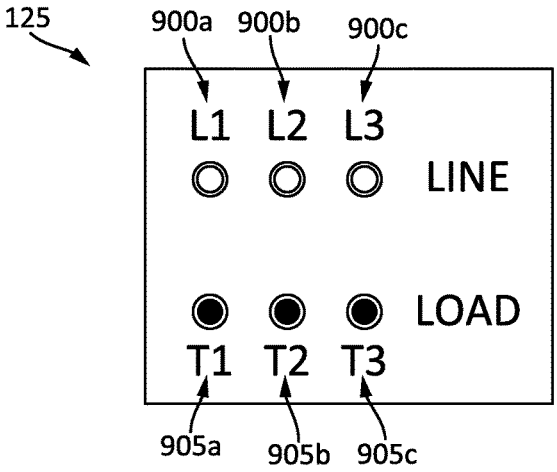
FIG. 11 illustrates an indicator of the power switch enclosure of FIG. 1 according to some embodiments of the application.

FIG. 11 illustrates the indicator 125 according to some embodiments of the application. The indicator 125 provides indication to a user. In the illustrated embodiment, the indicator 125 includes a first line indicator 900*a*, a second line indicator 900*b*, a third line indicator 900*c*, a first load indicator 905*a*, a second load indicator 905*b*, and a third load indicator 905*c*. The line indicators 900*a*-900*c* provide indication to the user that line power is electrically connected to the power switch enclosure 100 via the line input 805. The load indicators 905*a*-905*c* provide indication to the user that the line power is being provided to the load. In some embodiments, the line indicators 900 and load indicators 905 are light-emitting diodes (LEDs). In other embodiments, the line indicators 900 and load indicators 905 may be audible indicators.

In the illustrated embodiment, the line power is a three-phase electric power. In such an embodiment, the first line indicator 900*a* and first load indicator 905*a* correspond to a first phase, the second line indicator 900*b* and second load indicator 905*b* correspond to a second phase, and the third line indicator 900*c* and third load indicator 905*c* correspond to a third phase. In other embodiments, the line power may be single-phase. In such an embodiment, the indicator may include only a single line indicator 900 and a single load indicator 905.

Figure 12:
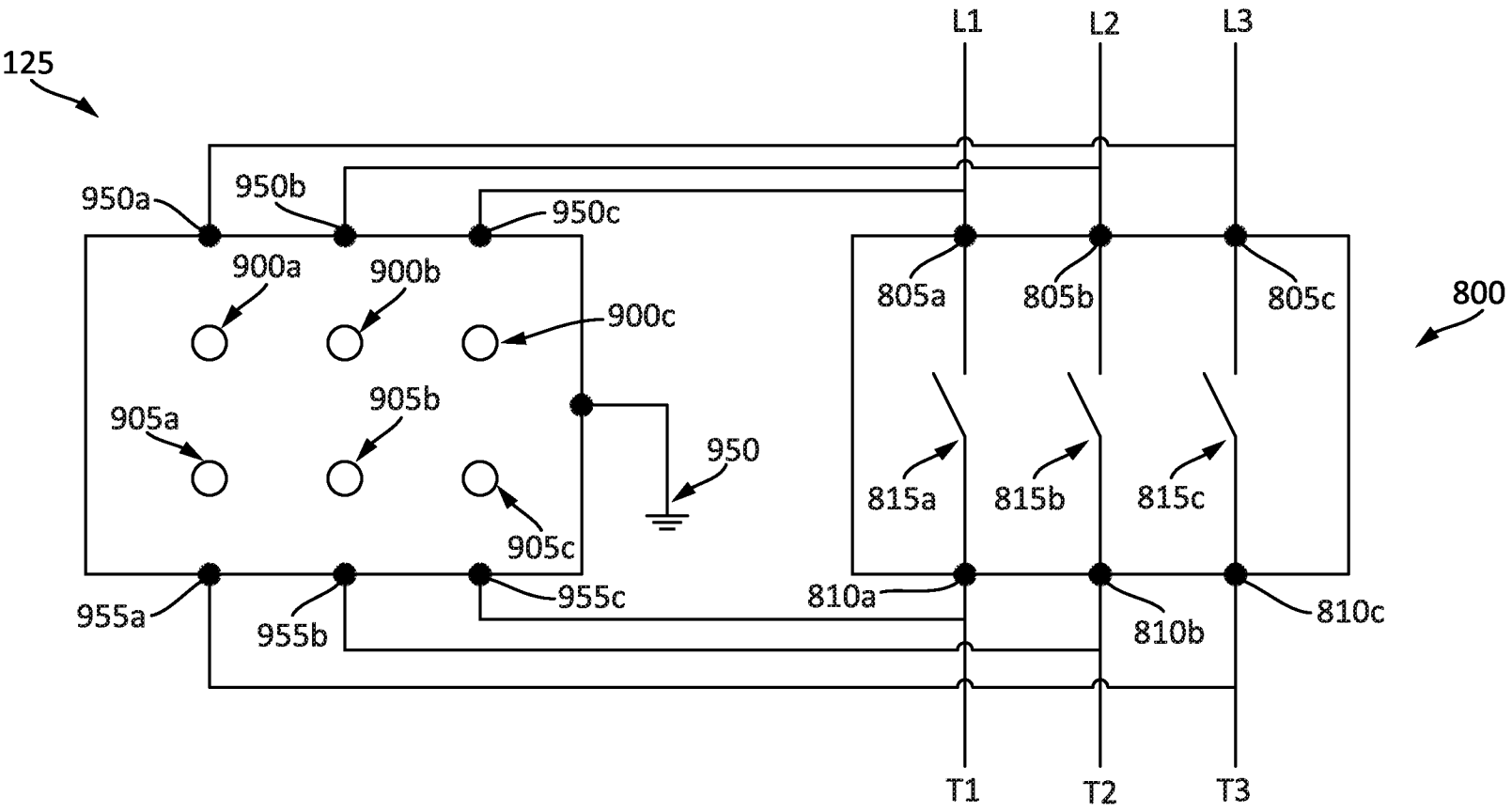
FIG. 12 illustrates a circuit diagram of the indicator of FIG. 11 electrically coupled to a switch of the power switch enclosure of FIG. 1 according to some embodiments of the application.

FIG. 12 illustrates a circuit diagram of the indicator 125 electrically connected to the electrical switch 800 and ground 950. In the illustrated embodiment, the indicator 125 includes indicator line inputs 950*a*, 950*b*, 950*c* and indicator load inputs 955*a*, 955*b*, 955*c*. The indicator line inputs 950*a*, 950*b*, 950*c* are electrically connected to the electric switch 800 at the line inputs 805*a*, 805*b*, 805*c* and the indicator load inputs 955*a*, 955*b*, 955*c* are electrical connected to the electric switch 800 at the load outputs 810*a*, 810*b*, 810*c*. As discussed above, the electric switch 800 includes contacts 815*a*, 815*b*, 815*c* for selectively electrically connecting the line inputs 805*a*, 805*b*, 805*c* to the load output 810*a*, 810*b*, 810*c*.

Figure 13:
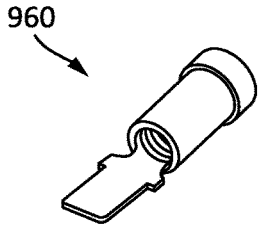
FIG. 13 illustrates a perspective view of a male tab of the power switch enclosure of FIG. 1 according to some embodiments of the application.

FIG. 13 illustrates a male tab 960 according to one or more embodiments of the application. In some embodiments, the indicator 125 (e.g., indicator line inputs 950*a*, 950*b*, 950*c* and indicator load inputs 955*a*, 955*b*, 955*c*) is electrically connected to the electrical switch 800 (e.g., the line inputs 805*a*, 805*b*, 805*c* and the load output 810*a*, 810*b*, 810*c*) and ground 950 via one or more male tabs 960. In such an embodiment, the male tabs 960 are configured to allow electrical connection of the high-power electrical switch 800 to the relatively low-power indicator 125. In some embodiments, the male tabs 960 are Rockwell® Sta-Kon 187 series tabs. In other embodiments, in lieu of male tabs 960, the power switch enclosure 100 includes one or more female tabs, or female disconnects, configured to operate in a similar manner as male tabs 960.

Figure 14:
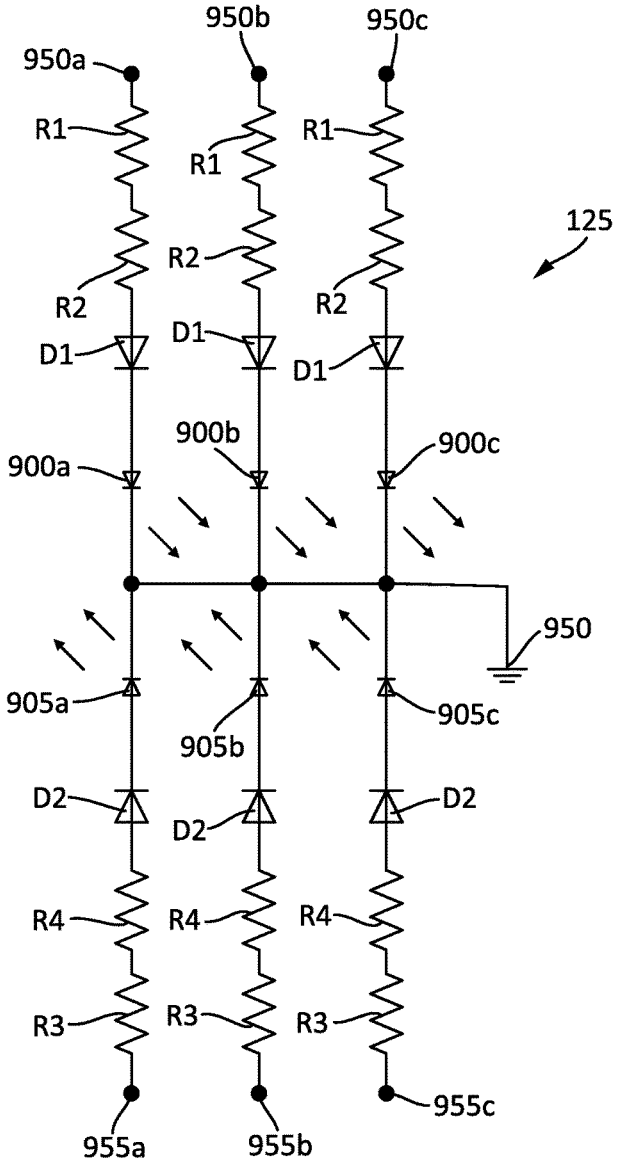
FIG. 14 illustrates a circuit diagram of the indicator of FIG. 11 according to some embodiments of the application.
Figure 15:
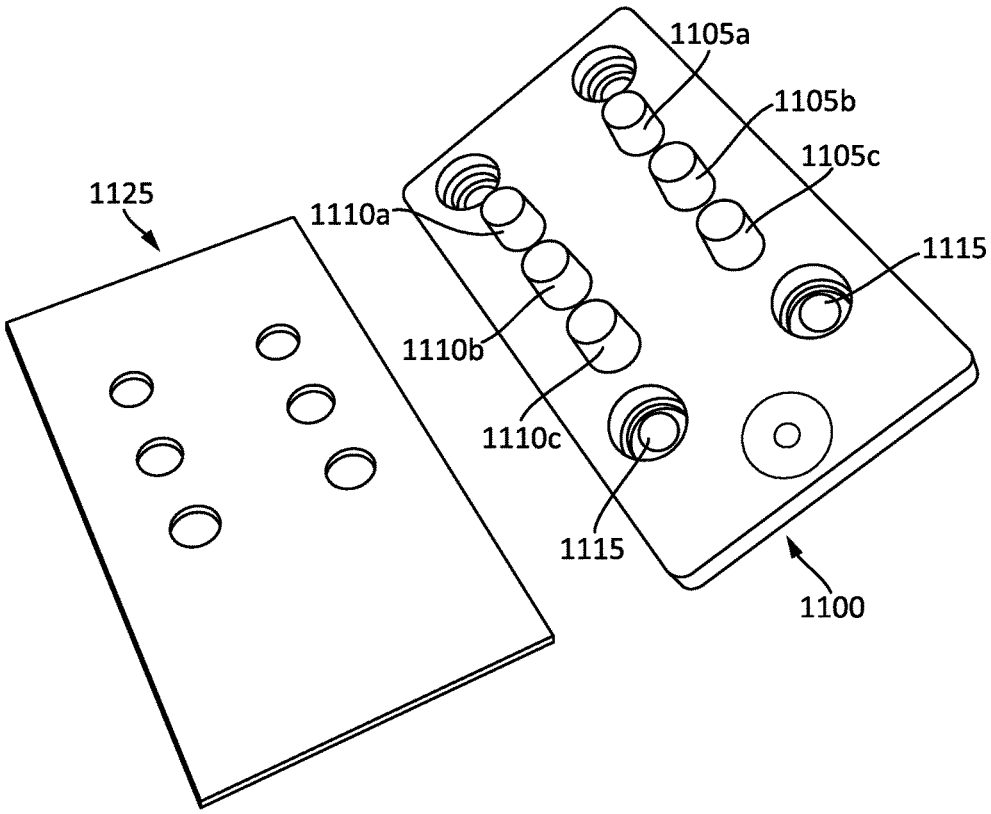
FIG. 15 illustrates an indicator lens of the power switch enclosure of FIG. 1 according to some embodiments of the application.
Figure 16:
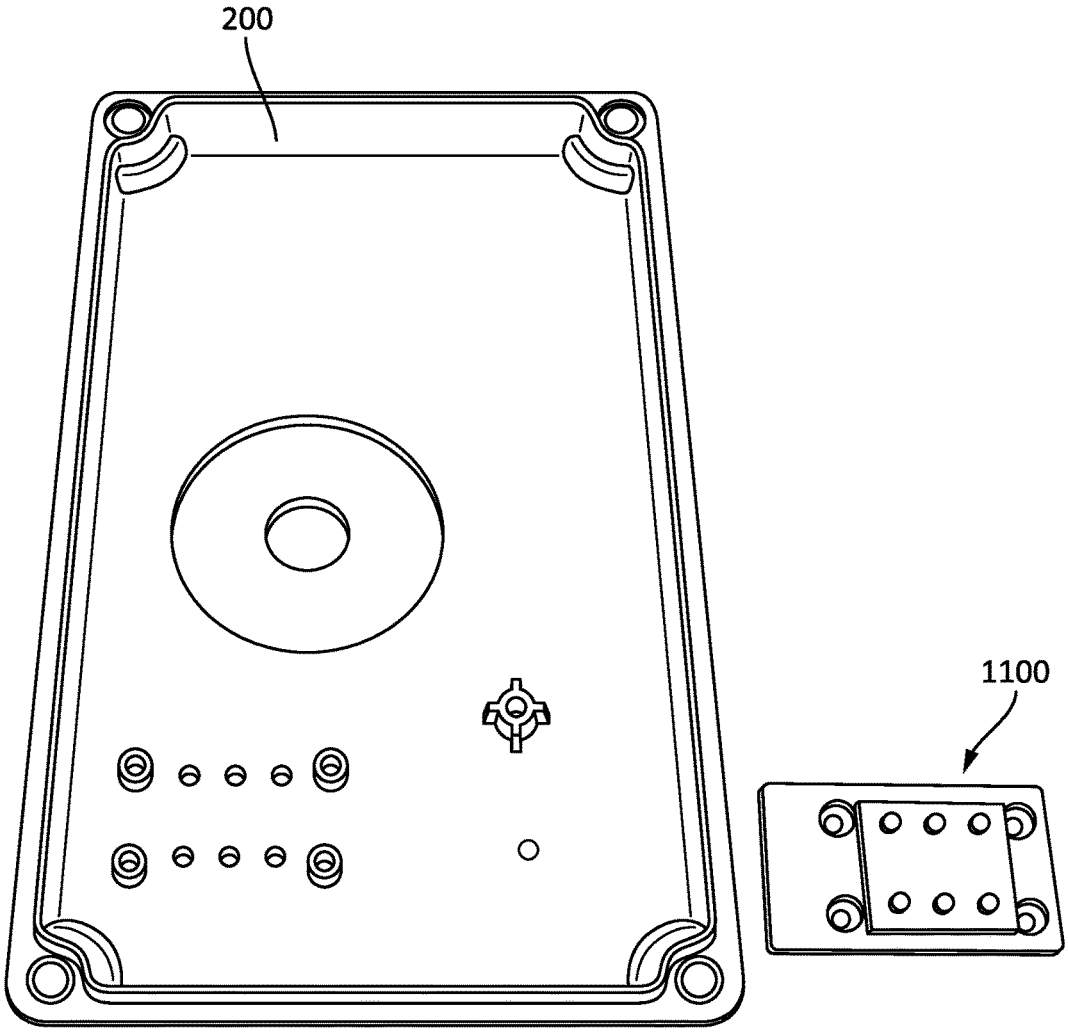
FIG. 16 illustrates the indicator lens of FIG. 15 and a rear portion of a front cover of the power switch enclosure of FIG. 1 according to some embodiments of the application.
Figure 17:
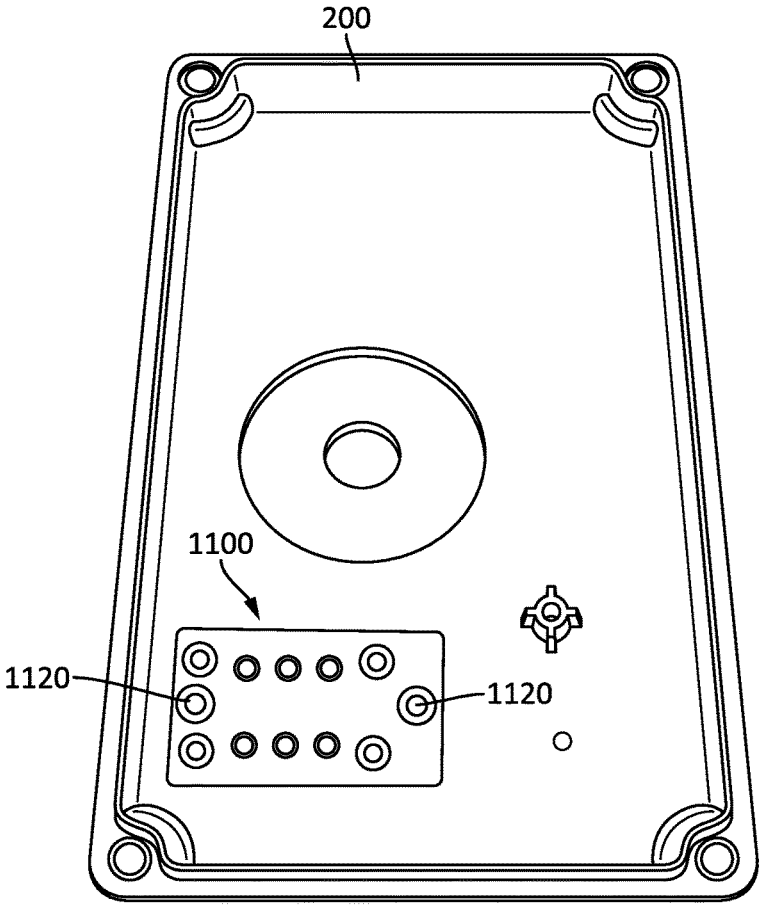
FIG. 17 illustrates the indicator lens of FIG. 15 coupled to a rear portion of a front cover of the power switch enclosure of FIG. 1 according to some embodiments of the application.
Figure 18:
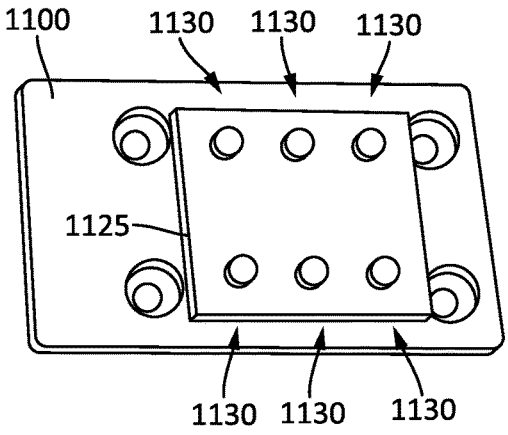
FIG. 18 illustrates a gasket coupled to the indicator lens of FIG. 15 according to some embodiments of the application.

FIG. 14 illustrates a circuit diagram of the indicator 125 according to some embodiments of the application. In the illustrated embodiment, the line input 805 includes line terminals 1005*a*, 1005*b*, and 1005*c*, while the load output 810 includes load terminals 1010*a*, 1010*b*, and 1010*c*. In other embodiments, the line power may be single-phase. In such an embodiment, the circuit diagram 1000 includes a single line terminal 1005 and a single load terminal 1010. The line terminals 1005*a*-1005*c* are each electrically connected in a series-type configuration to resistors R1 and R2, diodes D1, and the respective line indicators 900*a*-900*c*. The load terminals 1010*a*-1010*c* are each electrically connected in a series-type configured to resistors R3 and R4, diodes D2, and the respective load indicators 905*a*-905*c*. In some embodiments, resistors R1, R2, R3 and R4 are configured to handle approximately 1 W of power. Additionally, in some embodiments, diodes D1 and D2 are IN4007 type diodes.

FIGS. 15-19 illustrate an indicator lens 1100 according to some embodiments of the application. The indicator lens 1100 is configured to protect the indicator 125, as well as other internal circuitry of the power switch enclosure 100, from external elements. In some embodiments, the indicator lens 1100 may be formed of a clear plastic materials. In other embodiments, the indicator lens 1110 may be formed of a glass material. In the illustrated embodiment, the indicator lens 1100 includes line indicator lenses 1105*a*, 1105*b*, and 1105*c*, load indicator lenses 1110*a*, 1110*b*, and 1110*c*, one or more mounting apertures 1115, and one or indicator mounts 1120.

Figure 19:
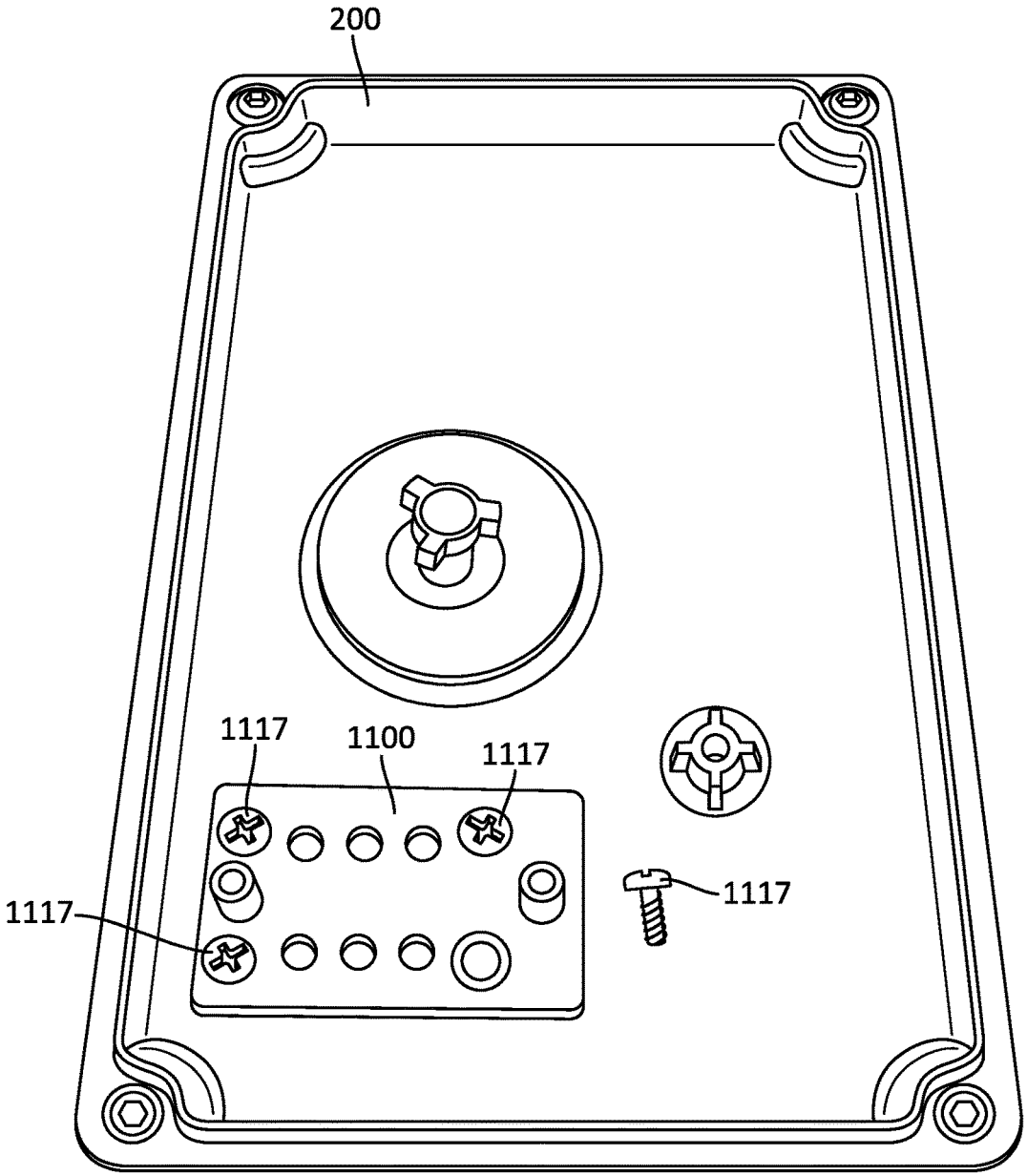
FIG. 19 illustrates a rear view of the housing including the indicator lens of FIG. 15 according to some embodiments of the application.

As illustrated, the indicator lens 1100 is configured to couple to the front cover 200 of the housing 105 and the indicator 125. In the illustrated embodiment, the indicator lens 1100 is coupled to the front cover 200 via the one or more mounting apertures 1115 (FIG. 15) and one or more fasteners 1117 (FIG. 19). In some embodiments, the one or more fasteners 1117 are screws. Additionally, in the illustrated embodiment, the indicator lens 1100 is coupled to the indicator 125 via the one or more indicator mounts 1120.

As illustrated, in some embodiments, a gasket 1125 may be configured to connect the indicator lens 1100 to the front cover 200. In such an embodiment, the gasket 1125 may include gasket apertures 1130 configured to receive line indicator lenses 1105*a*-1105*c* and load indicator lenses 1110*a*-1110*c*. The gasket 1125 provides additional protection of the indicator 125 and internal circuitry of the power switch enclosure 100 from external elements. Once the indicator lens 1100 is coupled to the front cover 200 and the indicator 125, the line indicators 900*a*-900*c* and the load indicators 905*a*-905*c* are visible through indicator apertures 1135 of the front cover 200 and the line indicator lenses 1105*a*-1105*c* and load indicator lenses 1110*a*-1110*c* of the indicator lens 1100. In some embodiments, the gasket 1125 may be formed of a rubber material. In other embodiments, the gasket 1125 is an adhesive tape. In such an embodiment, the adhesive tape may be a double-sided adhesive tape, such as but not limited to, 3M® VHB Adhesive Tape. Additionally, in such an embodiment, the gasket 1125 may be configured to secure the indicator lens 1100 to the front cover 200. In some embodiments, the indicator lens 1100 and the gasket 1125 are configured to provide a 4× enclosure rating for the power switch enclosure 100.

Figure 20:
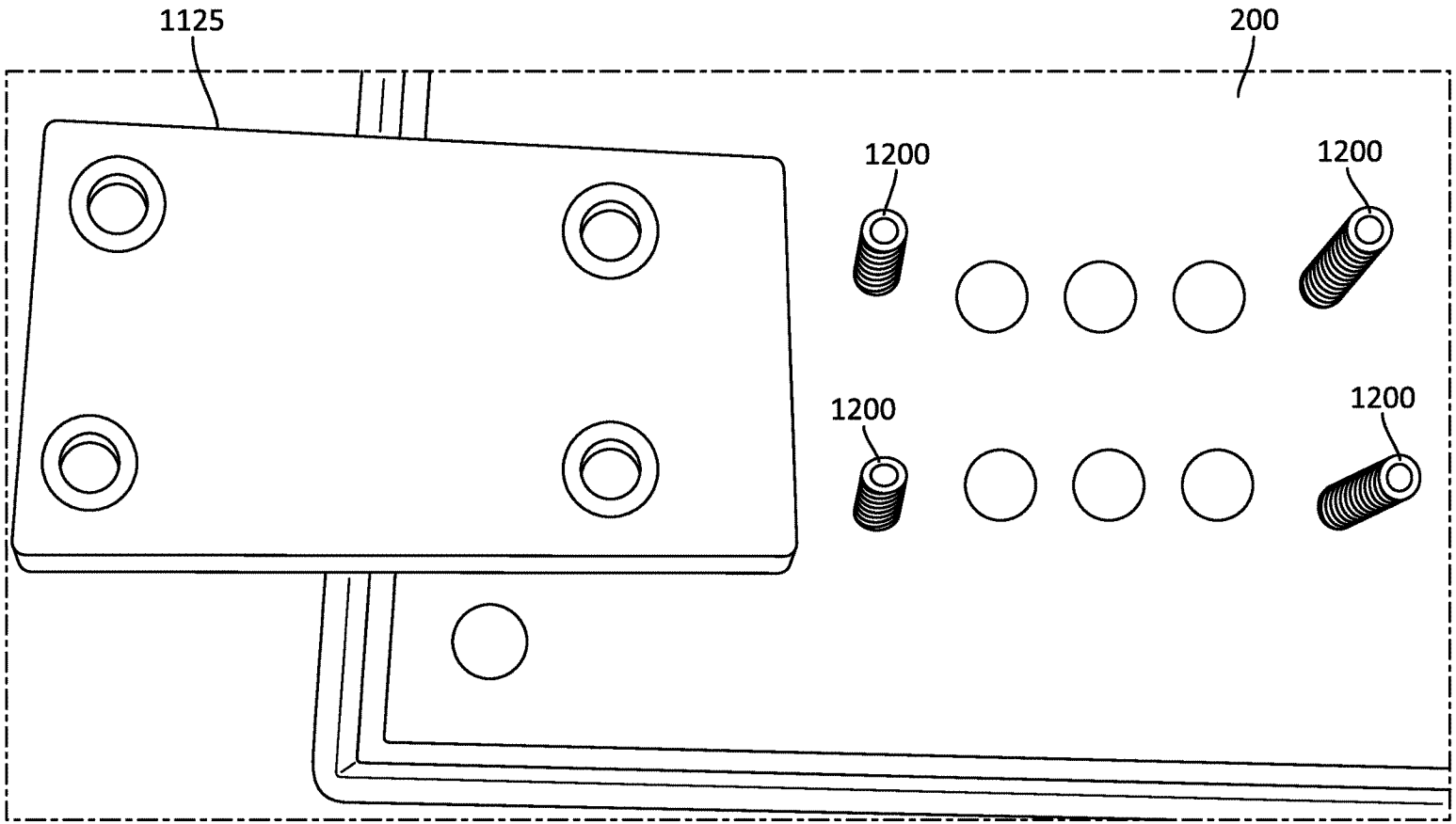
FIG. 20 illustrates a gasket and a front cover according to another embodiment of the application.
Figure 21:
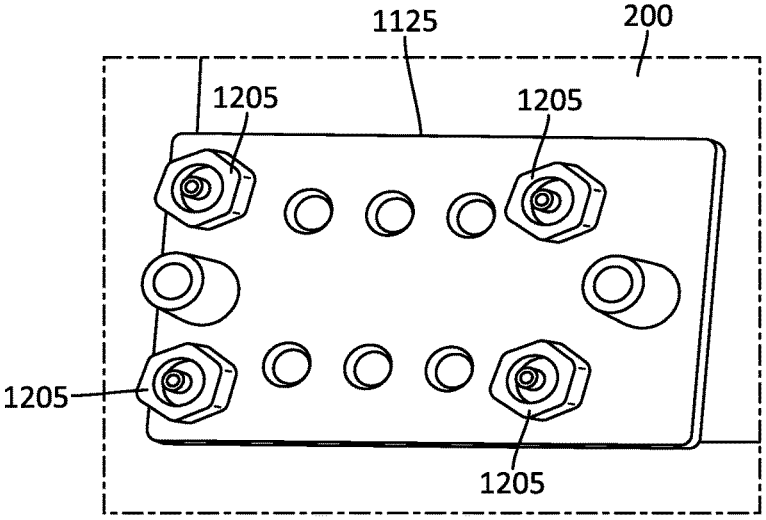
FIG. 21 illustrates the gasket of FIG. 19 coupled to the front cover according to some embodiments of the application.

FIGS. 19-21 illustrate the gasket 1125 being coupled to the front cover 200 according to another embodiment of the application. In such an embodiment, the front cover 200 includes one or more studs 1200. In some embodiments, the studs 1200 are coupled to the front cover 200, such as by, for example, one or more welds. Furthermore, in some embodiments, the studs 1200 may be threaded. As illustrated in FIG. 20, the gasket 1125 is secured to the front cover 200 by fasteners 1205. As illustrated in FIG. 21, the indicator lens 1100 may then be coupled to the gasket 1125.

Figure 22:
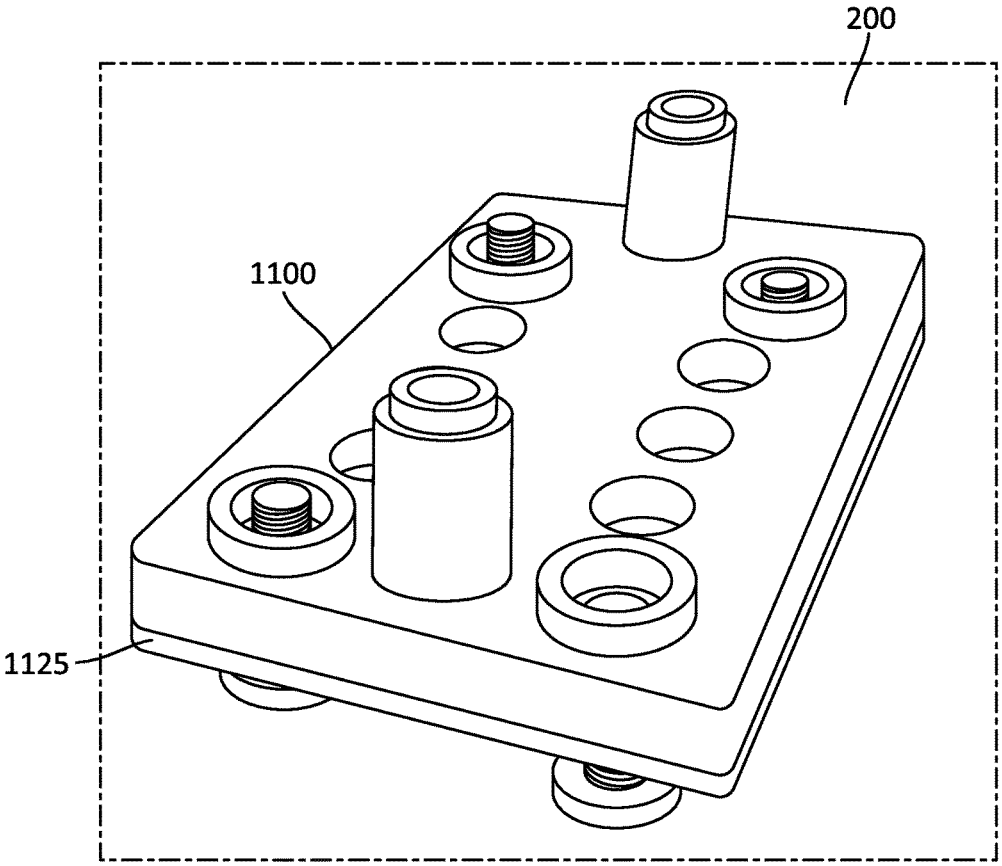
FIG. 22 illustrates an indicator lens coupled to the gasket and front cover of FIGS. 19 and 20 according to some embodiments of the application.
Figure 23A:
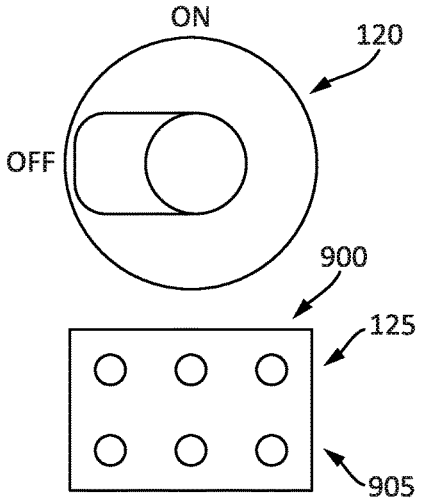
FIGS. 23A-23D illustrate various statuses provided by the indicator of FIG. 11 according to some embodiments of the application.
Figure 23B:
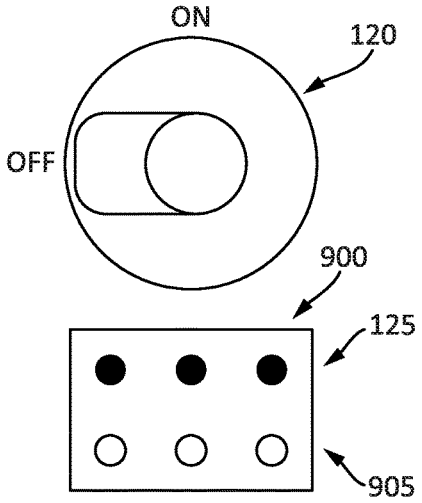
Figure 23C:
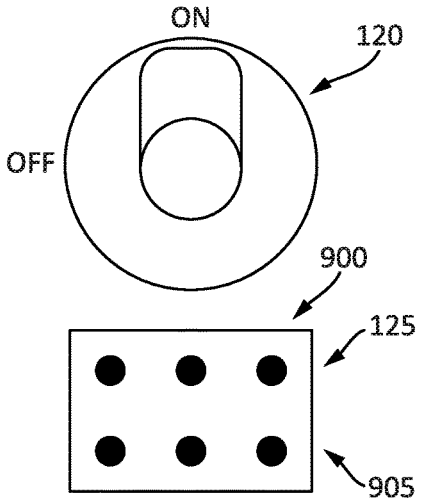
Figure 23D:
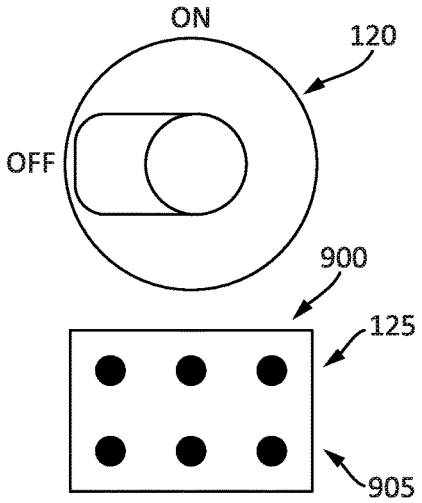

FIGS. 22A-22D illustrate various indications of the indicator 125 and user-switch 120. FIG. 22A illustrates a no-power status. When the no-power status is indicated, no line power is being received at the line input 805, therefore no line indicators 900 (e.g., 900*a*-900*c*) are illuminated and no load indicators 905 (e.g., 905*a*-905*c*) are illuminated. During the no-power status, the user-switch 120 could also be in the ON position, but since no line power is received at the line input 805, no indicators are illuminated and no line power is provided to the load. Furthermore, the no-power status may indicate phase failures, for example, by only indicating one or two of the line indicator 900*a*-900*c*.

FIG. 22B illustrates a normal OFF status. When the normal OFF status is indicated, line power is received at the line input 805, however the line power is not being delivered to the load. When in the normal OFF status, the user-switch is in the OFF position, line indicators 900 are illuminated, and load indicators 905 are not illuminated.

FIG. 22C illustrates a normal ON status. When the normal ON status is indicated, line power is received at the line input and line power is being delivered to the load. When in the normal ON status, the user-switch is in the ON position, line indicators 900 are illuminated, and load indicators 905 are illuminated.

FIG. 22D illustrates an error status. When the error status is indicated, line power is received at the line input and the user-switch is in the OFF position, however line power is being delivered to the load. In some embodiments, the error status indicates that one or more contacts have welded or another error condition exists. When in the error status, the user-switch is in the OFF position, line indicators 900 are illuminated, and load indicators 905 are illuminated. Although illustrated as having all line indicators 900 and load indicators 905 being indicated, an error condition may exist when one or more load indicators 905 are illuminated.

Figure 24:
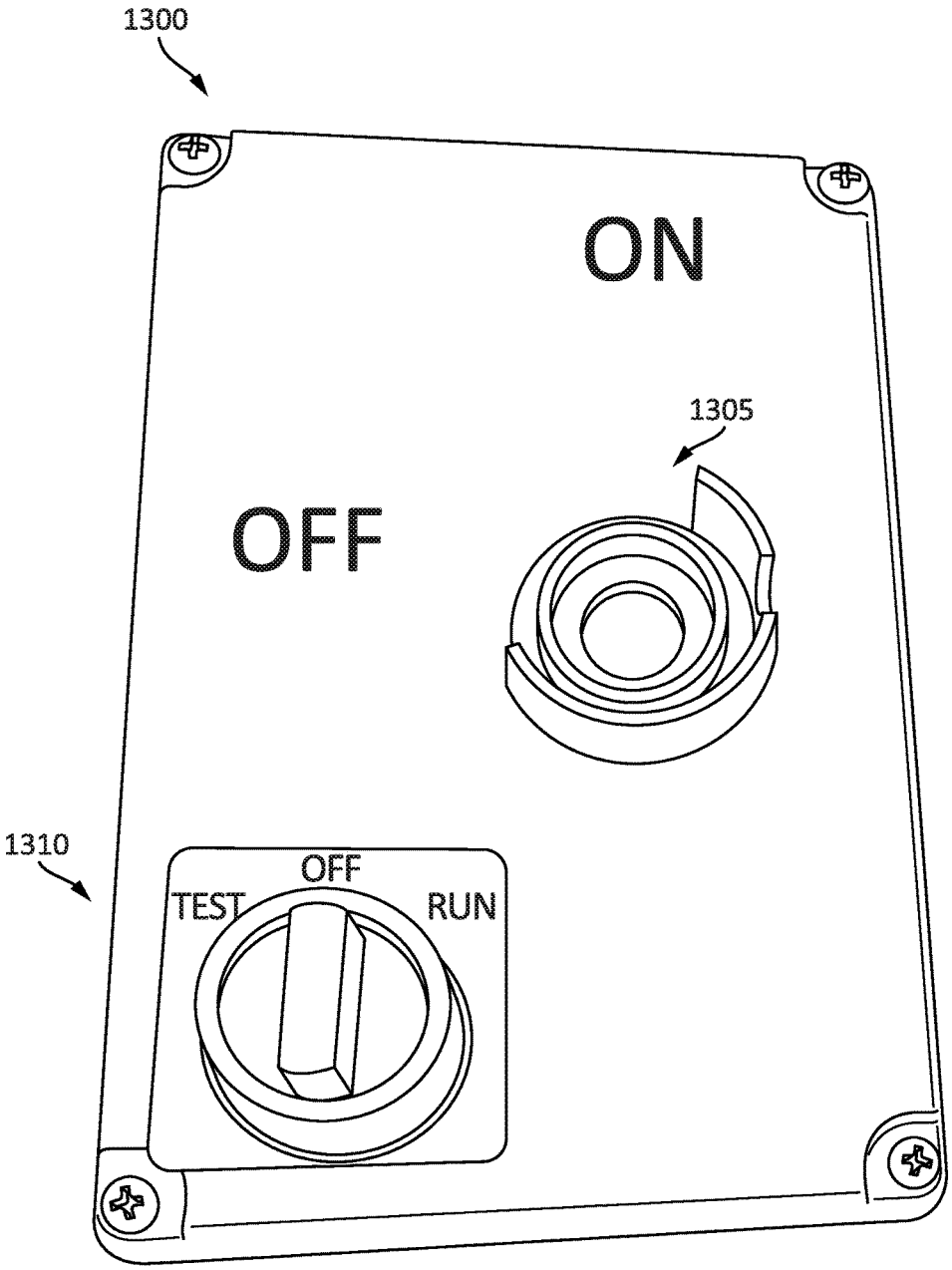
FIG. 24 illustrates a front view of a power switch enclosure according to another embodiment of the application.
Figure 25B:
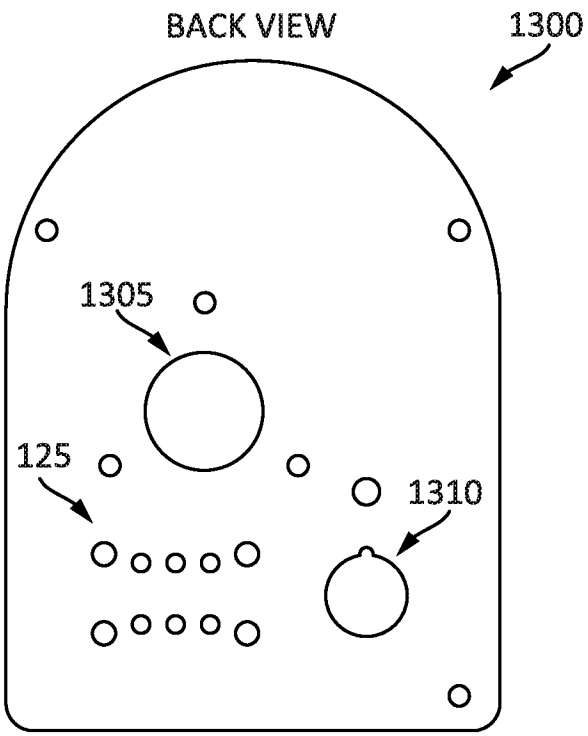
FIG. 25B illustrates a rear view of the housing of the power switch enclosure of FIG. 23 according to some embodiments of the application.
Figure 25A:
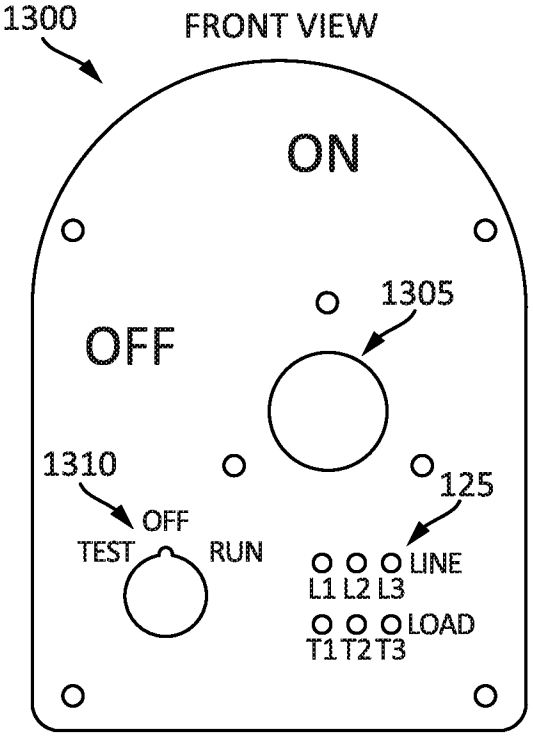
FIG. 25A illustrates a front view of a housing of the power switch enclosure of FIG. 23 according to some embodiments of the application.

FIGS. 23, 24A, and 24B illustrate a power switch enclosure 1300 according to another embodiment of the application. In some embodiments, the power switch enclosure 1300 is substantially similar to, and includes substantially similar components as, power switch enclosure 100. For example, the power switch enclosure 1300 includes an aperture 1305 configured to receive the user-switch 120 and the indicator 125. Additionally, the power switch enclosure 1300 may further include a second user-switch 1310. The second user-switch 1310 may be a low-powered auxiliary switch configured to selectively control power to an auxiliary device and/or equipment. In some embodiments, the second user-switch 1310 is a jog switch having two or more positions.

Thus, the invention provides, among other things, a power switch enclosure providing indication to a user. Various features and advantages of the invention are set forth in the following claims.

What is claimed is:

1. A power switch comprising:
- a line input configured to receive a line voltage;
- a load output configured to output the line voltage;
- a contact configured to selectively electrically connect the line input to the load output, the contact having
  - a closed position in which the line input is electrically connected to the load output, and
  - an open position in which the line input is not electrically connected to the load output;
- a switch configured to selectively control the contract between the open position and the closed position, the switch having
  - an on position wherein the contact is controlled to be in the closed position, and
  - an off position wherein the contact is controlled to be in the open position; and
- an indicator including a line diode, a line light-emitting diode, a load diode, and a load light-emitting diode, the indicator providing
  - a normal on status wherein the indicator is activate when the switch is in the on position and the contact is in the closed position,
  - a normal off status wherein the indicator is inactive when the switch is in the off position and the contact is in the open position, and
  - an error on status wherein the indicator is active when the switch is in the off position and the contact is in the closed position.

2. The power switch of claim 1, wherein the indicator indicates when a welded contact condition exists.

3. The power switch of claim 1, wherein the indicator is electrically coupled to the switch via at least one selected from a group consisting of a male tab and a female tab.

4. The power switch of claim 1, wherein the indicator is electrically connected to ground via at least one selected from a group consisting of a male tab and a female tab.

5. A power switch comprising:
- a line input configured to receive a line voltage;
- a load output configured to output the line voltage;
- a contact configured to selectively electrically connect the line input to the load output, the contact having
  - a closed position in which the line input is electrically connected to the load output, and
  - an open position in which the line input is not electrically connected to the load output
- a switch configured to selectively control the contract between the open position and the closed position, the switch having
  - an on position wherein the contact is controlled to be in the closed position, and
  - an off position wherein the contact is controlled to be in the open position; and
- an indicator providing
  - a normal on status wherein the indicator is activate when the switch is in the on position and the contact is in the closed position,
  - a normal off status wherein the indicator is inactive when the switch is in the off position and the contact is in the open position, and
  - an error on status wherein the indicator is active when the switch is in the off position and the contact is in the closed position;
- a housing including a rear portion and a front cover coupled to the rear portion, the indicator supported by the front cover; and
- an indicator lens positioned between the indicator and the front cover.

6. The power switch of claim 5, further comprising a gasket positioned between the indicator lens and the front cover.

7. The power switch of claim 6, wherein the gasket is comprised of at least one selected from the group consisting of rubber and adhesive.

8. The power switch of claim 5, wherein the indicator lens is comprised of plastic.

9. The power switch of claim 5, wherein the indicator includes a line indicator and a load indicator.

10. The power switch of claim 9, wherein the indicator lens includes a line indicator lens and a load indicator lens.

11. The power switch of claim 5, wherein the front cover is a replacement cover.

12. A power switch comprising:
- a line input configured to receive a line voltage;

a load output configured to output the line voltage;

a contact configured to selectively electrically connect the line input to the load output, the contact having a closed position in which the line input is electrically connected to the load output, and an open position in which the line input is not electrically connected to the load output;

a switch configured to selectively control the contract between the open position and the closed position, the switch having an on position wherein the contact is controlled to be in the closed position, and an off position wherein the contact is controlled to be in the open position; and an indicator providing a normal on status wherein the indicator is activate when the switch is in the on position and the contact is in the closed position, a normal off status wherein the indicator is inactive when the switch is in the off position and the contact is in the open position, and an error on status wherein the indicator is active when the switch is in the off position and the contact is in the closed position;

a housing; and a mounting foot configured to secure the housing to a surface, the mounting foot including a molding, and an insert contained within the molding.

13. The power switch of claim 12, wherein the molding is comprised of a plastic material.

14. The power switch of claim 12, wherein the insert is comprised of a metal material.

15. A power switch comprising:

a line input configured to receive a line voltage;

a load output configured to output the line voltage;

a contact configured to selectively electrically connect the line input to the load output, the contact having a closed position in which the line input is electrically connected to the load output, and an open position in which the line input is not electrically connected to the load output a switch configured to selectively control the contract between the open position and the closed position, the switch having an on position wherein the contact is controlled to be in the closed position, and an off position wherein the contact is controlled to be in the open position; and an indicator providing a normal on status wherein the indicator is activate when the switch is in the on position and the contact is in the closed position, a normal off status wherein the indicator is inactive when the switch is in the off position and the contact is in the open position, and an error on status wherein the indicator is active when the switch is in the off position and the contact is in the closed position;

a front cover including a retainer configured to captivate a fastener; and a rear housing configured to be coupled to the front cover via the fastener.

16. The power switch of claim 15, wherein the retainer is a retaining ring.

17. The power switch of claim 15, wherein the retainer is integrated into the front cover.

18. The power switch of claim 15, wherein the fastener includes a groove and a threaded portion.

19. The power switch of claim 18, wherein the fastener is captivated at the groove.

* * * * *